US009920881B2

(12) United States Patent
Nakamura et al.

(10) Patent No.: US 9,920,881 B2
(45) Date of Patent: Mar. 20, 2018

(54) PRESSURE CONTAINER

(71) Applicant: Yachiyo Industry Co., Ltd., Sayama-shi, Saitama (JP)

(72) Inventors: Kazuhiro Nakamura, Saitama (JP); Kojiro Ooe, Saitama (JP)

(73) Assignee: YACHIYO INDUSTRY CO., LTD., Sayama-Shi (JP)

( * ) Notice: Subject to any disclaimer, the term of this patent is extended or adjusted under 35 U.S.C. 154(b) by 0 days.

(21) Appl. No.: 14/893,560

(22) PCT Filed: Dec. 9, 2014

(86) PCT No.: PCT/JP2014/082508
§ 371 (c)(1),
(2) Date: Nov. 24, 2015

(87) PCT Pub. No.: WO2015/114953
PCT Pub. Date: Aug. 6, 2015

(65) Prior Publication Data

US 2016/0123532 A1 May 5, 2016

(30) Foreign Application Priority Data

Jan. 28, 2014 (JP) ..... 2014-013056

(51) Int. Cl.
*F17C 1/02* (2006.01)
*F17C 1/06* (2006.01)
*F17C 1/16* (2006.01)

(52) U.S. Cl.
CPC ..... *F17C 1/02* (2013.01); *F17C 1/06* (2013.01); *F17C 1/16* (2013.01);
(Continued)

(58) Field of Classification Search
CPC ..... F17C 1/02; F17C 1/16; F17C 2203/011; F17C 2203/0604; F17C 2203/066;
(Continued)

(56) References Cited

U.S. PATENT DOCUMENTS 5,429,845 A * 7/1995 Newhouse ..... F17C 1/16 138/30
5,839,600 A * 11/1998 Moreira ..... F17C 1/16 220/560.04

(Continued)

FOREIGN PATENT DOCUMENTS

CN 1074281 A 7/1993
CN 102192323 A 9/2011

(Continued)

OTHER PUBLICATIONS

Chinese Office Action dated Jun. 3, 2016, 5 pages.
International Search Report dated Mar. 17, 2015, Application No. PCT/JP2014/082508, English translation included.

*Primary Examiner* — Andrew Perreault
*Assistant Examiner* — Robert Poon
(74) *Attorney, Agent, or Firm* — Rankin, Hill & Clark LLP

(57) ABSTRACT

It is an object of the present invention to provide a pressure container configured so that a seal member is excellent at maintainability and has a simple structure. The container includes a hollow plastic liner (2) provided with a projected cylindrical neck portion (2*b*), and to reserve gas or liquid; a mouthpiece member (3) disposed outside the neck portion (2*b*) in a radial direction; a reinforced layer (4) covering outsides of the plastic liner (2) and the mouthpiece member (3); an attachment member (5) capable of being inserted between the neck portion (2*b*) and the mouthpiece member (3), and attachable to and detachable from the mouthpiece member (3); and a first seal member (6) disposed between an
(Continued)

outer peripheral surface of the neck portion (2*b*) and an inner peripheral surface of the attachment member (5).

2 Claims, 6 Drawing Sheets

(52) U.S. Cl.
CPC ..... *F17C 2201/0109* (2013.01); *F17C 2201/056* (2013.01); *F17C 2203/011* (2013.01); *F17C 2203/0604* (2013.01); *F17C 2203/066* (2013.01); *F17C 2203/0619* (2013.01); *F17C 2203/0663* (2013.01); *F17C 2203/0675* (2013.01); *F17C 2205/0305* (2013.01); *F17C 2260/012* (2013.01); *F17C 2260/036* (2013.01)

(58) Field of Classification Search
CPC .. F17C 2205/0305; F17C 13/06; F17C 13/02; F17C 1/04; F17C 1/06; B65D 51/16; F16J 13/02
USPC ..... 220/582, 586
See application file for complete search history.

(56) References Cited

U.S. PATENT DOCUMENTS 5,938,209 A 8/1999 Sirosh et al.
6,186,356 B1 * 2/2001 Berkley ..... F17C 1/00 220/304
8,640,910 B2 * 2/2014 Novak ..... F17C 1/16 220/566
2008/0251520 A1 * 10/2008 Ota ..... F17C 1/16 220/586
2009/0071930 A1 * 3/2009 Sato ..... F17C 1/06 215/380
2011/0220661 A1 * 9/2011 Strack ..... F16J 12/00 220/586
2011/0284562 A1 11/2011 Novak et al.
2012/0085727 A1 * 4/2012 Fratti ..... F17C 1/16 215/386
2013/0049256 A1 2/2013 Tani et al.
2013/0299504 A1 * 11/2013 Koppert ..... F17C 1/06 220/586
2014/0263366 A1 * 9/2014 Breuer ..... F17C 1/005 220/586

FOREIGN PATENT DOCUMENTS

CN 102392894 A 3/2012
CN 102906484 A 1/2013
CN 202834720 U 3/2013
JP 11-044399 2/1999
JP 2005-265138 9/2005
JP 2010-529391 8/2010
JP 2013-002493 1/2013
WO 2008/153414 12/2008

* cited by examiner

PRESSURE CONTAINER

TECHNICAL FIELD

The present invention relates to a pressure container to reserve gas or liquid.

BACKGROUND ART

There is known a pressure container capable of reserving a high pressure gas or liquid therein. In recent years, a pressure container of a composite structure is proposed, which container is made by covering a thin container (plastic liner) of synthetic resin with a fiber reinforced layer into which resin is impregnated, and then by curing the resin, in order to lighten the pressure container.

For example, a pressure container disclosed in the patent literature 1 is composed of a plastic liner provided with a projected neck portion, a mouthpiece member disposed on the inside of the plastic liner, and a fiber reinforced plastic layer (FRP layer) covering the plastic liner and the mouthpiece member. A seal member of an O-ring intervenes between the plastic liner and the mouthpiece member. The seal member intervenes between an outer peripheral surface of a flange of the mouthpiece member and an inner peripheral surface of the plastic liner.

PRIOR ART LITERATURE

Patent Literature

Patent literature 1: Japanese Patent Laid-Open Publication No. 2005-265138

SUMMARY OF THE INVENTION

Problems to be Solved by the Invention

Because the plastic liner and the mouthpiece member are different from each other in their materials, it is not easy to keep high seal ability. There is also a problem that the cost to manufacture the pressure container and the material cost increase in a case where the sealing mechanism is constituted to a complex one to improve the seal ability.

Furthermore, in a case where the seal member deteriorates, because maintenance and replacement of the seal member cannot be done for the pressure container having the conventional constitution, there is a problem that the pressure container needs to be replaced with a new one.

The present invention is created to solve such problems, and it is an object of the present invention to provide a pressure container having high maintainability for a seal member and a simple construction.

Means for Solving the Problems

In order to solve the problems, the present invention provides a pressure container, including: a hollow plastic liner provided with a projected cylindrical neck portion, and to reserve gas or liquid; a mouthpiece member disposed outside the neck portion in a radial direction; a reinforced layer covering outsides of the plastic liner and the mouthpiece member; an attachment member capable of being inserted between the neck portion and the mouthpiece member, and attachable to and detachable from the mouthpiece member; and a first seal member intervened between an outer peripheral surface of the neck portion and an inner peripheral surface of the attachment member.

According to the constitution, since the first seal member is intervened between the outer peripheral surface of the neck portion and the inner peripheral surface of the attachment member, maintenance, replacement or the like of the first seal member can be done when the attachment member is detached from the mouthpiece member. Thereby, maintainability for the first seal member can be improved. And outward force in the radial direction acts upon the neck portion when inner pressure acts upon the plastic liner, so that self-sealing function operates and the sealing can be firmly performed. Furthermore, communication passage of the pressure container to communicate with the outside is one route between the neck portion and the attachment member. So sealing mechanism can be put together to this communication passage. Thereby, the sealing mechanism can be simplified.

It is preferable that the attachment member has a divided structure including a first member to be fastened to the mouthpiece member, and a second member to be inserted between the neck portion and the mouthpiece member, the first seal member is intervened between the outer peripheral surface of the neck portion and an inner peripheral surface of the second member, the second seal member is intervened between the first member and the second member, and that the second member is held by the mouthpiece member and the first member. That is, it is also possible that the attachment member is composed of separated elements.

Axial force and circumferential force act upon the first seal member because of friction between the neck portion and the attachment member when the attachment member is fastened to the mouthpiece member, so that there is a fear that the first seal member is not located at a predetermined position. However, since according to this invention, the first member and the second member are separately formed, the first seal member can be disposed between the neck portion and the second member without rotating the second member. Namely, since circumferential force does not act upon the first seal member when the second member is inserted, the first seal member can be firmly located at a predetermined position.

Furthermore, it is preferable that a reinforcing member is disposed on the neck portion.

Rigidity of the neck portion is lowered and the neck portion becomes easy to weaken, because of aging change. However, according to such constitution, the rigidity of the neck portion can be enhanced. Thereby, the seal ability can be kept over a long period of time.

Effect of the Invention

The pressure container according to the present invention has high maintainability for a seal member and a simple construction.

MODE FOR CARRYING OUT THE INVENTION

First Embodiment

Figure 1:
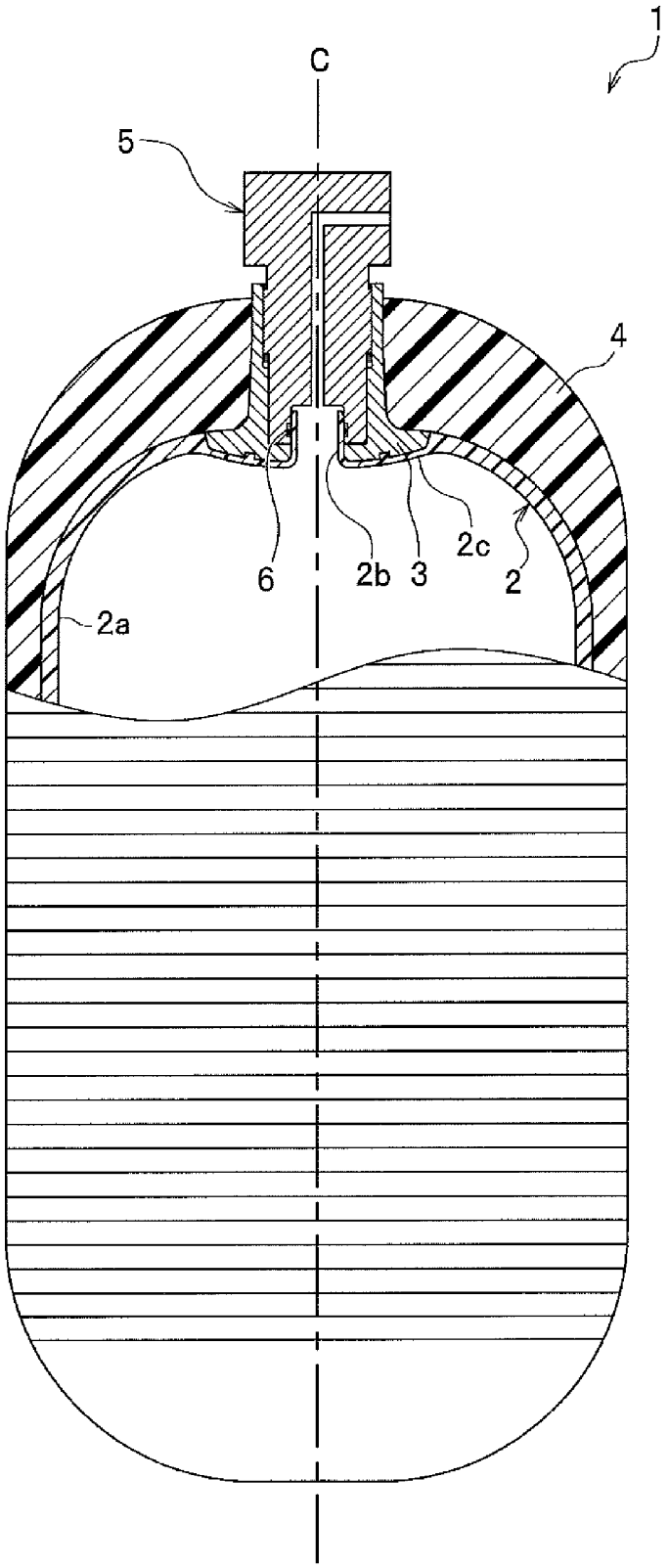
FIG. 1 is a partially broken side view showing a pressure container according to a first embodiment of the present invention.

An embodiment of the present invention will be explained in detail with reference to the drawings. As shown in FIG. 1, a pressure container 1 according to this embodiment is mainly composed of a plastic liner 2, a mouthpiece member 3, a reinforced layer 4, an attachment member 5, and a first seal member 6. The pressure container 1 is a hollow container capable of reserving, for example, liquid or gas therein.

As shown in FIG. 1, the plastic liner 2 is made of resin and the inside of the liner 2 is hollow. Material of the plastic liner 2 is not specifically limited, and according to a kind or use of gas or liquid to be housed, for example, polyethylene (PE), high density polyethylene (HDPE), polyamide, polyketone, polyphenylene sulfide (PPS), and so on are used. The plastic liner 2 can be lightened by making the liner of resin.

In this embodiment, the plastic liner 2 is composed of a housing portion 2*a*, a neck portion 2*b*, and a shoulder portion 2*c*. The housing portion 2*a* has a cylindrical shape, and reserves liquid or gas. The neck portion 2*b* projects toward the outside in a pour-discharge direction along a central axis C. The shoulder portion 2*c* connects the housing portion 2*a* and the neck portion 2*b*. The housing portion 2*a*, the neck portion 2*b*, and the shoulder portion 2*c* are formed integrally in this embodiment, but the liner may be formed by welding a plurality of pieces. Furthermore, the shape of the housing portion 2*a* is not specifically limited, for example, may be spherical.

Figure 2:
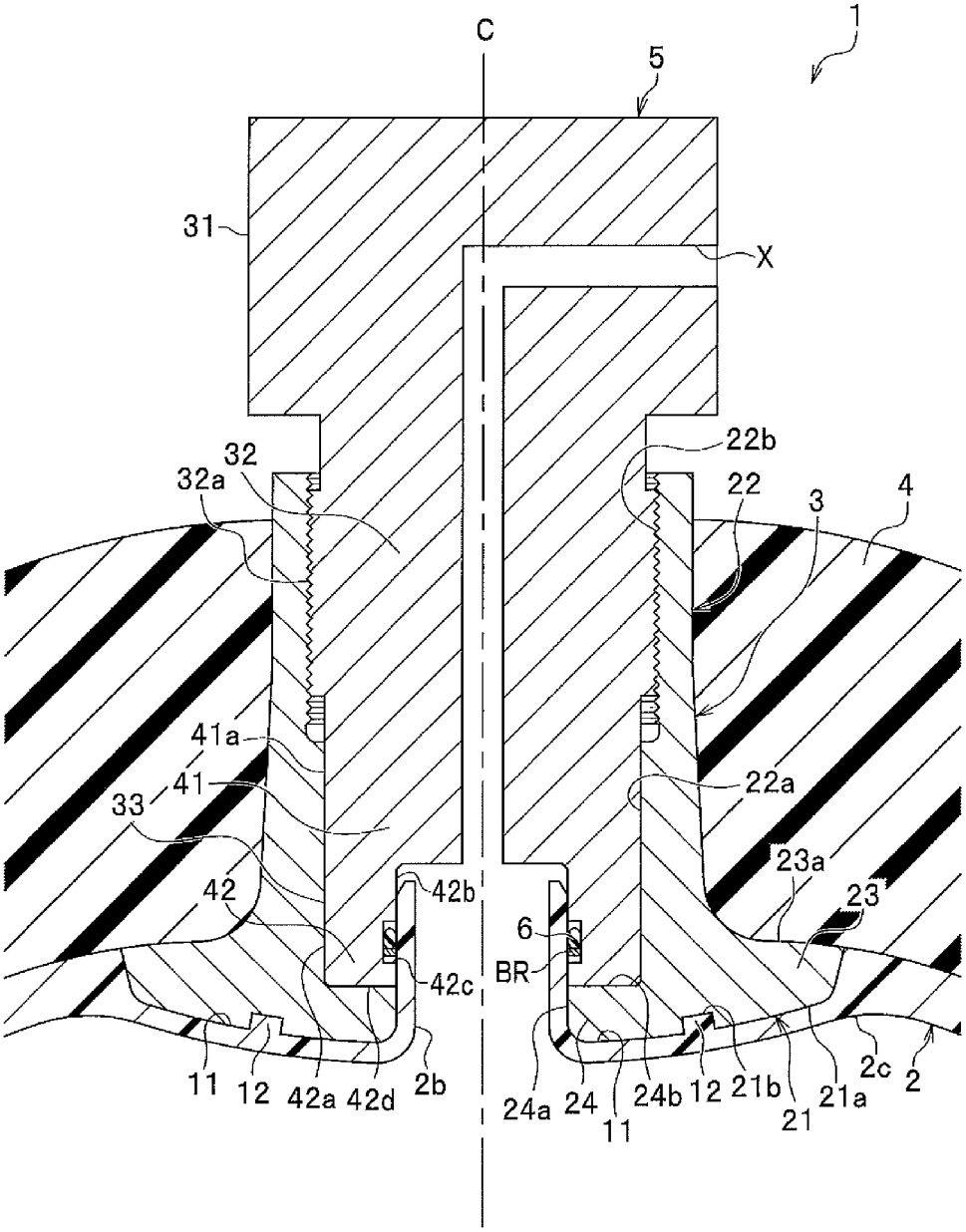
FIG. 2 is a sectional side view showing a periphery of a mouthpiece member of the pressure container according to the first embodiment.

As shown in FIG. 2, the neck portion 2*b* has a cylindrical shape, and stands up from the shoulder portion 2*c*. The height of the neck portion 2*b* is smaller than that of a standing portion 22 to be described later. The outer peripheral part of the tip end of the neck portion 2*b* is chamfered off.

The shoulder portion 2*c* is a portion where the mouthpiece member 3 is disposed. The shoulder portion 2*c* is provided with a recessed part 11 and a projecting part 12. The recessed part 11 is a hollow formed around the neck portion 2*b*. The projecting part 12 is a part projected from the bottom surface of the recessed part 11, and functions as a stopper to avoid the rotation of the mouthpiece member 3. A plurality of projecting parts 12 are formed intermittently around the neck portion 2*b*.

As shown in FIG. 2, the mouthpiece member 3 is a metallic member which is disposed outside the neck portion 2*b* in the radial direction. The mouthpiece member 3 is composed of a flange portion 21 and the standing portion 22. The flange portion 21 has a ring-shape, which is a portion to be disposed on the recessed part 11 of the shoulder portion 2*c*. A plurality of grooves 21*b* are formed intermittently in a circumferential direction on a bottom surface 21*a* of the flange portion 21. In a forming process to be described later, resin material flows into each of the plurality of grooves 21*b* to become the projecting part 12 which is the stopper to avoid the rotation. The flange portion 21 has an outer flange 23 and an inner flange 24. The outer flange 23 is a flange extending outside the standing portion 22 in the radial direction. The inner flange 24 is a flange extending inside the standing portion 22 in the radial direction.

An outer peripheral surface 23*a* of the outer flange 23 is flush with an outer surface of the shoulder portion 2*c*. A front end surface 24*a* of the inner flange 24 is in contact with an outer peripheral surface of the neck portion 2*b* in a surface-contact state.

The standing portion 22 has a cylindrical shape, and stands on the flange portion 21 roughly orthogonally. A base end side inner peripheral surface 22*a* formed on the base end side of the standing portion 22 is smooth. On the other hand, a female thread is formed on a front end side inner surface 22*b* formed on the front end side of the standing portion 22.

The reinforced layer 4 is a layer of FRP (fiber reinforced plastic), which is formed to cover outer peripheral surfaces of the plastic liner 2 and the mouthpiece member 3. Material of the reinforced layer 4 is not limited to the fiber reinforced plastic, and may be formed of other materials (or material) capable of enhancing the strength of the plastic liner 2.

As shown in FIG. 2, the attachment member 5 is a member attachable to and detachable from the mouthpiece member 3. A front end side of the attachment member 5 is inserted between the neck portion 2*b* and the mouthpiece member 3, and a base end side thereof is fixed (fastened) to the mouthpiece member 3. The attachment member 5 may be another member like a joint member or a valve.

The attachment member 5 is composed of a main body portion 31, a fixing portion 32, and a front end portion 33. Material of the attachment member 5 is not specifically limited, and is a metal (metals) in this embodiment.

The fixing portion 32 is continuous with the main body portion 31, and has a cylindrical shape. A male thread, which is screwed to the female thread on the front end side inner surface 22*b*, is formed on an outer peripheral surface 32*a* of the fixing portion 32.

The front end portion 33 is a portion formed on the front end side of the attachment member 5. The front end portion 33 is composed of a base part 41 continuous with the fixing portion 32, and a leg part 42 formed on the front end side. The base part 41 has a cylindrical shape. A communication hole X is formed at centers of the main body portion 31, the fixing portion 32 and the base part 41.

The leg part 42 is continuous with the base part 41, and has a cylindrical shape. An inner peripheral surface 42*b* of the leg part 42 is in contact with the outer peripheral surface of the neck portion 2*b* in a surface-contact state. That is, an inner diameter of the inner peripheral surface 42*b* is substantially the same as an outer diameter of the neck portion 2*b*.

An outer peripheral surface 41*a* of the base part 41 is flush with an outer peripheral surface 42*a* of the leg part 42. It is preferable that the outer peripheral surfaces 41*a* and 42*a* are in contact with the base end side inner peripheral surface 22*a* in a surface-contact state. However, they may be disposed in a state having a minute gap against the base end side inner peripheral surface 22*a*.

An attachment seat 42*c* to dispose a first seal member 6 therein is formed to be a recessed part on the inner peripheral surface 42*b*. The attachment seat 42*c* has a rectangular shape in a cross section thereof, and is formed along the whole circumference of the inner peripheral surface 42*b*. A front end surface 42*d* of the leg part 42 is in contact with a surface 24*b* of the inner flange 24 in a surface-contact state.

The first seal member 6 is a member to seal a gap between the neck portion 2*b* and the leg part 42. The first seal member 6 is an o-ring in this embodiment. The first seal member 6 is in contact with both of the outer peripheral surface of the neck portion 2*b* and the inner peripheral surface 42*b* (attachment seat 42*c*). In this embodiment, a backup ring BR is adjacent to the first seal member 6. The backup ring BR may be disposed in a case of being needed.

Next, a method of manufacturing the pressure container 1 of this embodiment will be explained. In this method of manufacturing the pressure container, a forming process, a reinforcement layer forming process, and an attachment process are carried out. First, in the forming process, the plastic liner 2 and the mouthpiece member 3 are formed integrally. In this embodiment, the plastic liner 2 and the mouthpiece member 3 are formed integrally by rotational molding or injection molding.

In the reinforcement layer forming process, the reinforced layer 4 is formed on both outer peripheries of the plastic liner 2 and the mouthpiece member 3, for example, by filament winding method.

In the attachment process, the attachment member 5 is attached to the mouthpiece member 3. First, the first seal member 6 and the backup ring BR are disposed in the attachment seat 42*c* of the attachment member 5. And then, the fixing portion 32 of the attachment member 5 is fastened to the front end side inner surface 22*b* of the mouthpiece member 3 until the front end surface 42*d* of the leg part 42 comes into contact with the surface 24*b* of the mouthpiece member 3. Thereby, the leg part 42 of the mouthpiece member 3 is inserted between the neck portion 2*b* and the mouthpiece member 3. Through the above processes, the pressure container 1 is formed.

According to the pressure container 1 explained in the foregoing, the first seal member 6 is intervened between the outer peripheral surface of the neck portion 2*b* and the inner peripheral surface 42*b* of the leg part 42. So an inspection or an exchange of the first seal member 6 can be done when the attachment member 5 is detached from the mouthpiece member 3. Thereby, maintainability for the first seal member 6 can be improved. And outward force in the radial direction acts upon the neck portion 2*b* when inner pressure acts upon the plastic liner 2. Therefore, self-sealing function operates, so that the sealing can be firmly performed.

Furthermore, communication passage of the pressure container 1 to communicate with the outside is one route between the neck portion 2*b* and the leg part 42 of the attachment member 5. So the sealing mechanism can be put together to this communication passage. Thereby, the sealing mechanism can be simplified.

And furthermore, on the base side of the neck portion 2*b*, the outer peripheral surface of the neck portion 2*b* and the front end surface 24*a* of the inner flange 24 are in contact with each other. So the neck portion 2*b* can be reinforced. Furthermore, chamfering process has been done at the front end outer peripheral part (corner part) of the neck portion 2*b*. So the leg part 42 can be easily inserted between the neck portion 2*b* and the mouthpiece member 3 when the attachment member 5 is attached to the mouthpiece member 3.

First Modified Example of First Embodiment

Figure 3:
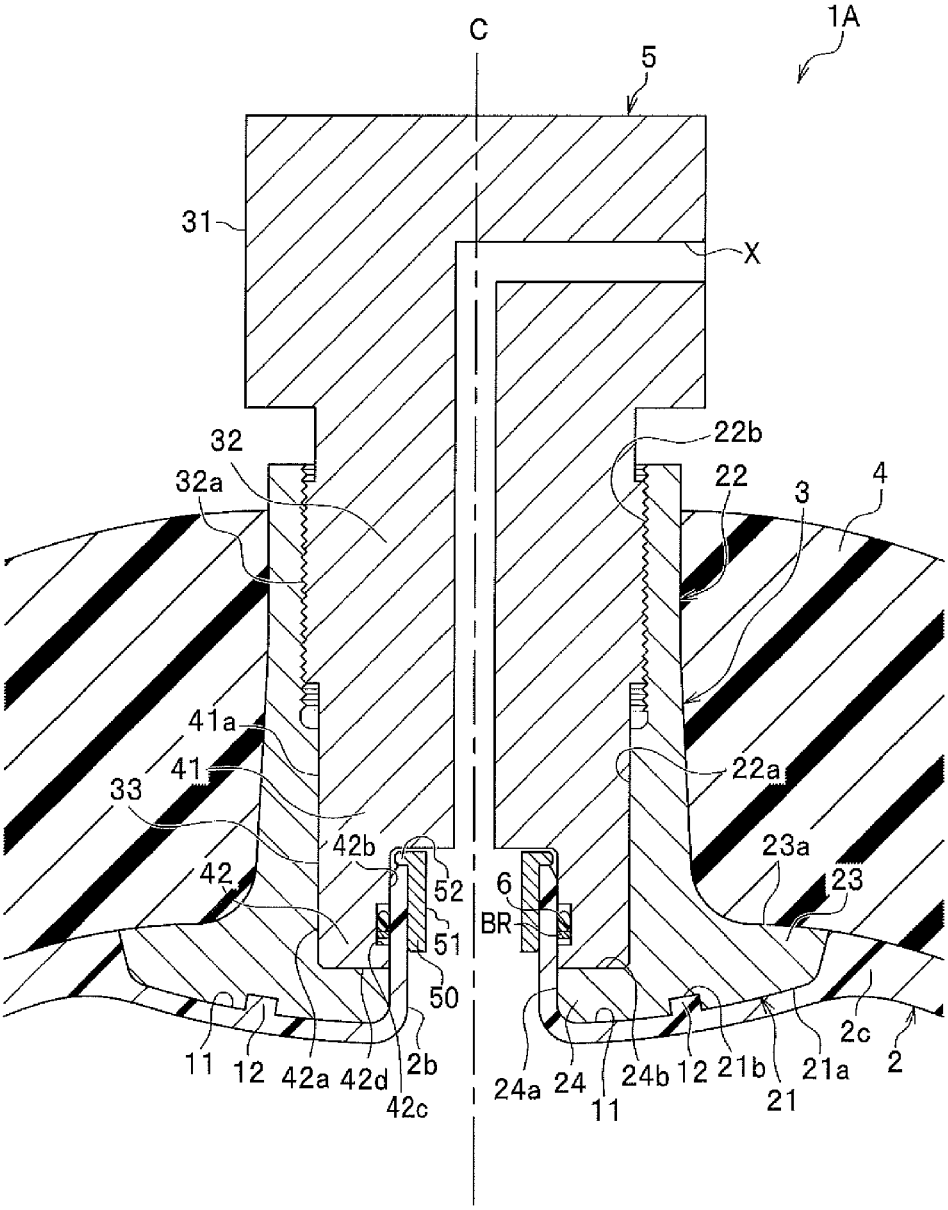
FIG. 3 is a sectional side view showing a periphery of a mouthpiece member of a first modified pressure container according to the first embodiment.

Next, a first modified example of the first embodiment will be explained. As shown in FIG. 3, a pressure container 1A of the first modified example differs from the first embodiment on the point of being provided with a reinforcing member 50. In the first modified example, detailed explanations will be omitted except for giving the same symbols to portions overlapping with the first embodiment. Portions different from the first embodiment will be mainly explained.

The reinforcing member 50 is a member to reinforce the neck portion 2*b*. The reinforcing member 50 is made of metal in this embodiment, but has only to be made of material having hardness higher than the neck portion 2*b*. The reinforcing member 50 is composed of a base body 51 and a flange 52. The base body 51 has a cylindrical shape. An outer peripheral surface of the base body 51 is contact with the inner peripheral surface of the neck portion 2*b* in a surface-contact state.

The flange 52 extends outward in the radial direction from a front end (end on the outside in the pour-discharge direction) of the base body 51. The flange 52 is contact with the front end surface of the neck portion 2*b* in a surface-contact state. A length from the outer peripheral surface of the base body 51 to the front end of the flange 52 is shorter than the thickness of the neck portion 2*b*.

Next, a method of manufacturing the pressure container of the first modified example will be explained. In the method of manufacturing the pressure container of the first modified example, a forming process, a fitting process, a reinforcement layer forming process, and an attachment process are carried out.

The forming process is the same as that of the first embodiment. The fitting process is a process that the reinforcing member 50 is fitted to the neck portion 2*b*. In the fitting process, the flange 52 and the front end surface of the neck portion 2*b* come into contact with each other while the base body 51 of the reinforcing member 50 is inserted into the inner peripheral surface of the neck portion 2*b*. The reinforcement layer forming process and the attachment process are the same as those in the first embodiment.

The first modified example mentioned above can also serve the same effect as the first embodiment. Furthermore, the neck portion 2*b* can be reinforced by attaching the reinforcing member 50 to the neck portion 2*b*. A contacting surface of the neck portion 2*b*, which surface is in contact with the first seal member 6, becomes easy to weaken because of aging change by the effect of the reaction force of the first seal member 6. However, the rigidity thereof can be improved over a long period of time by disposing the reinforcing member 50. Thus the seal ability for the pressure container 1A can keep over a long period of time.

Second Modified Example of First Embodiment

Figure 4:
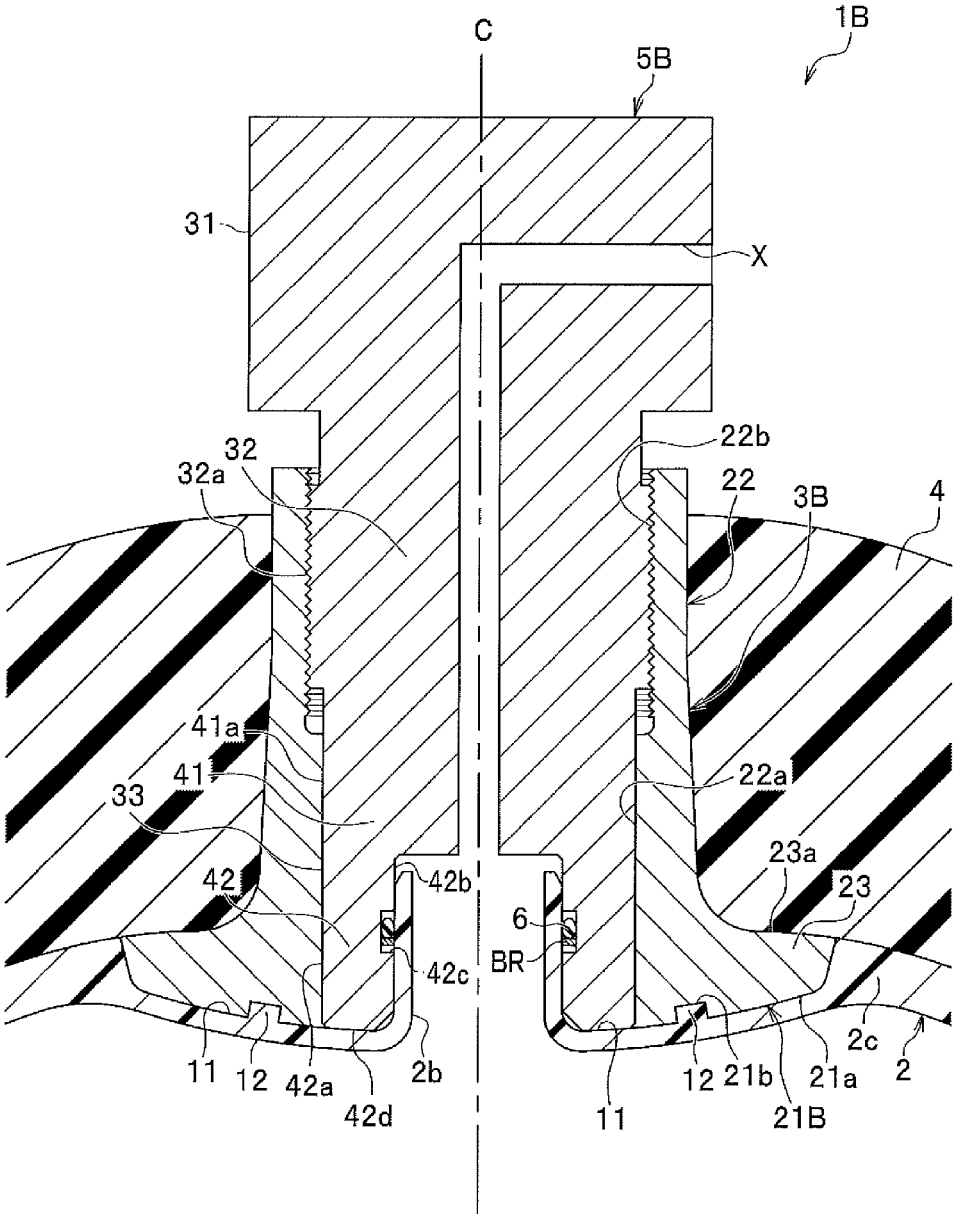
FIG. 4 is a sectional side view showing a periphery of a mouthpiece member of a second modified pressure container according to the first embodiment.

Next, a second modified example of the first embodiment will be explained. As shown in FIG. 4, a pressure container 1B of the second modified example differs from the first embodiment on the point that the mouthpiece member 3 does not have the inner flange 24 (refer to FIG. 2). In the second modified example, detailed explanations will be omitted except for giving the same symbols to portions overlapping with the first embodiment. Portions different from the first embodiment will be mainly explained.

As shown in FIG. 4, the pressure container 1B of the second modified example is composed of the plastic liner 2, a mouthpiece member 3B, the reinforced layer 4, and an attachment member 5B.

The mouthpiece member 3B is a metal member to be disposed outside the neck member 2*b* in the radial direction. The mouthpiece member 3B has the standing portion 22 and a flange portion 21B. The flange portion 21B is provided with the outer flange 23 extending outside in the radial direction from the standing portion 22.

The attachment member 5B is composed of the main body portion 31, the fixing portion 32, and the front end portion 33 (base part 41, leg part 42). The attachment member 5B is the same as the attachment member 5 of the first embodiment except that the front end surface 42*d* of the leg part 42 is in contact with the bottom surface of the recessed part 11 of the shoulder portion 2*c*.

The pressure container 1B of the second modified example mentioned above can also serve an effect that is roughly the same as the first embodiment. And since the base side of the neck portion 2*b* comes into contact with the inner peripheral surface 42*b* of the leg part 42 in a surface-contact state, the neck portion 2*b* can be reinforced.

Second Embodiment

Figure 5:
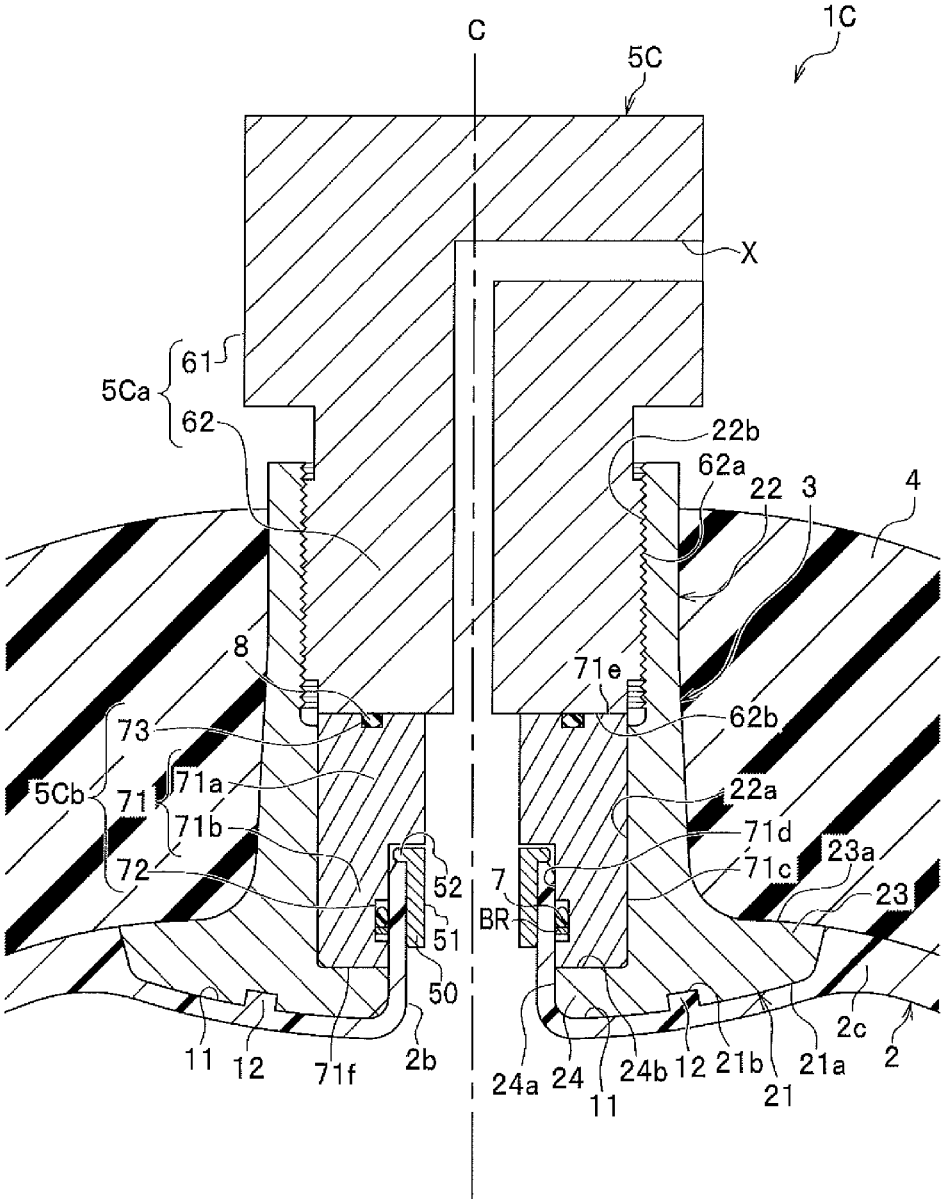
FIG. 5 is a sectional side view showing a periphery of a mouthpiece member of a pressure container according to a second embodiment.

Next, a pressure container according to a second embodiment of the present invention will be explained. As shown in FIG. 5, a pressure container 1C according to this embodiment is composed of the plastic liner 2, the mouthpiece member 3, the reinforced layer 4, an attachment member 5C, a first seal member 7, a second seal member 8, and the reinforcing member 50. The pressure container 1C according to the second embodiment largely differs from the first embodiment on the point that the attachment member 5C is composed of a plurality of components. In the second embodiment, detailed explanations will be omitted except for giving the same symbols to portions overlapping with the first embodiment. Portions different from the first embodiment will be mainly explained.

The attachment member 5C is a member configured to be attachable to and detachable from the mouthpiece member 3. A front end side of the attachment member 5C is inserted between the neck portion 2*b* and the mouthpiece member 3, and a base end side thereof is fixed (fastened) to the mouthpiece member 3. The attachment member 5C may be, for example, another member like a joint member or a valve.

The attachment member 5C is composed of a first member 5Ca and a second member 5Cb. Materials of the first member 5Ca and the second member 5Cb are not specifically limited, and in this embodiment, they are made of metal. The first member 5Ca is a member which is fastened to the mouthpiece member 3, and a portion of which member is exposed outside the pressure container 1C. The first member 5Ca is composed of a main body portion 61 and a fixing portion 62.

The main body portion 61 is a portion to be gripped when the attachment member 5C is fastened to the mouthpiece member 3. The main body portion 61 has a larger diameter than that of the fixing portion 62. The fixing portion 62 is continuous with the main body portion 61 and has a columnar shape. A male thread to be screwed to the female thread of the front end side inner surface 22*b* is formed on an outer peripheral surface 62*a* of the fixing portion 62. The communication hole X is formed at the centers of the fixing portion 62 and the main body portion 61.

The second member 5Cb is inserted between the neck portion 2*b* and the mouthpiece member 3, and is held between the first member 5Ca and the inner flange 24 because of axial force due to fastening of the first member 5Ca. The second member 5Cb is composed of a cylindrical portion 71 having a cylindrical shape, a first attachment seat 72 formed on the cylindrical portion 71, and a second attachment seat 73 formed on the cylindrical portion 71.

A height length of the cylindrical portion 71 is roughly equal to a height length of the base end side inner peripheral surface 22*a* of the standing portion 22. The cylindrical portion 71 is composed of a thick part 71*a* and a thin part 71*b*. The thin part 71*b* is a part to be inserted between the neck portion 2*b* and the mouthpiece member 3. The thickness of the thin part 71*b* is roughly equal to a distance from the neck portion 2*b* to the standing portion 22. That is, an outer peripheral surface 71*c* of the thin part 71*b* is in contact with the base end side inner peripheral surface 22*a* in a surface-contact state. Furthermore, an inner peripheral surface 71*d* of the thin part 71*b* is in contact with the outer peripheral surface of the neck portion 2*b* in a surface-contact state. And furthermore, it is preferable that the outer peripheral surface 71*c* is in contact with the base end side inner peripheral surface 22*a* in a surface-contact state, but may be disposed with a minute gap against the base end side inner peripheral surface 22*a*.

A base end surface 71*e* of the thick part 71*a* is in contact with an end surface 62*b* of the fixing portion 62 in a surface-contact state. Furthermore, a front end surface 71*f* of the thin part 71*b* is in contact with the surface 24*b* of the inner flange 24 in a surface-contact state.

The first attachment seat 72 is a seat to dispose the first seal member 7 therein, and is formed to be a recessed part on the inner peripheral surface 71*d* of the thin part 71*b*. The first attachment seat 72 is formed along the whole circumference of the inner peripheral surface 71*d*. The second attachment seat 73 is a seat to dispose the second seal member 8 therein, and is formed to be a recessed part on the base end surface 71*e* of the thick part 71*a*. The second attachment seat 73 is formed along the whole circumference of the thick part 71*a*. Sealing between the first member 5Ca and the second member 5Cb can be performed by intervening the second seal member 8 between them. Note that, the second attachment seat 73 may be formed at a corner defined by the base end surface 71*e* and an inner peripheral surface of the thick part 71*a* by cutting off the corner.

Furthermore, the reinforcing member 50 is attached to the neck portion 2*b*. Since the reinforcing member 50 is the same as that of the first modified example (refer to FIG. 3) of the first embodiment, detailed explanations will be omitted.

In the method of manufacturing the pressure container 1C of this embodiment, a forming process, a fitting process, a reinforcement layer forming process, and an attachment process are carried out. The forming process, the fitting process, and the reinforcement layer forming process are the same as those of the first embodiment or of the first modified example of the first embodiment. In the attachment process, first, the second member 5Cb is inserted between the neck portion 2*b* and the mouthpiece member 3 in the state that the first seal member 7 is disposed in the first attachment seat 72. After the second seal member 8 is disposed in the second attachment seat 73, the first member 5Ca is fastened to the mouthpiece member 3. The first member 5Ca is fastened to the mouthpiece member 3 until the end surface 62*b* of the fixing portion 62 comes into contact with the base end surface 71*e* of the thick part 71*a*. By the above-mentioned processes, the pressure container 1C is manufactured.

According to the above-explained pressure container 1C, since the first seal member 7 is intervened between the neck portion 2*b* and the second member 5Cb (cylindrical portion 71) of the attachment member 5C, and the second seal member 8 is intervened between the first member 5Ca and the second member 5Cb, maintenance, replacement, or the like of the first seal member 7 and the second seal member 8 can be done when the attachment member 5C is detached from the mouthpiece member 3. Thereby, maintainability for the first seal member 7 and the second seal member 8 can be improved. Furthermore, since outward force in the radial direction acts upon the neck portion 2*b* when inner pressure acts upon the plastic liner 2, self-sealing function operates, so that the sealing can be firmly performed.

When the attachment member 5 (refer to FIG. 2) of the first embodiment is fastened, axial force and circumferential force act upon the first seal member 6 because of friction between the neck portion 2*b* and the first seal member. Therefore, there is a fear that it becomes hard to dispose the first seal member 6 at a desired position. However, according to this embodiment, the second member 5Cb has only to be inserted to the neck portion 2*b* in the axial direction. Therefore, the circumferential force does not act upon the first seal member 7 in the attachment process. Thereby, the first seal member 7 can be certainly disposed in the first attachment seat 72.

Furthermore, on the base end side of the neck portion 2*b*, the outer peripheral surface of the neck portion 2*b* and the front end surface 24*a* of the inner flange 24 are in contact with each other. Therefore, the neck portion 2*b* can be reinforced. And furthermore, since the front end outer peripheral part of the neck portion 2*b* is chamfered, the second member 5Cb can be easily inserted to the neck portion 2*b*.

First Modified Example of Second Embodiment

Figure 6:
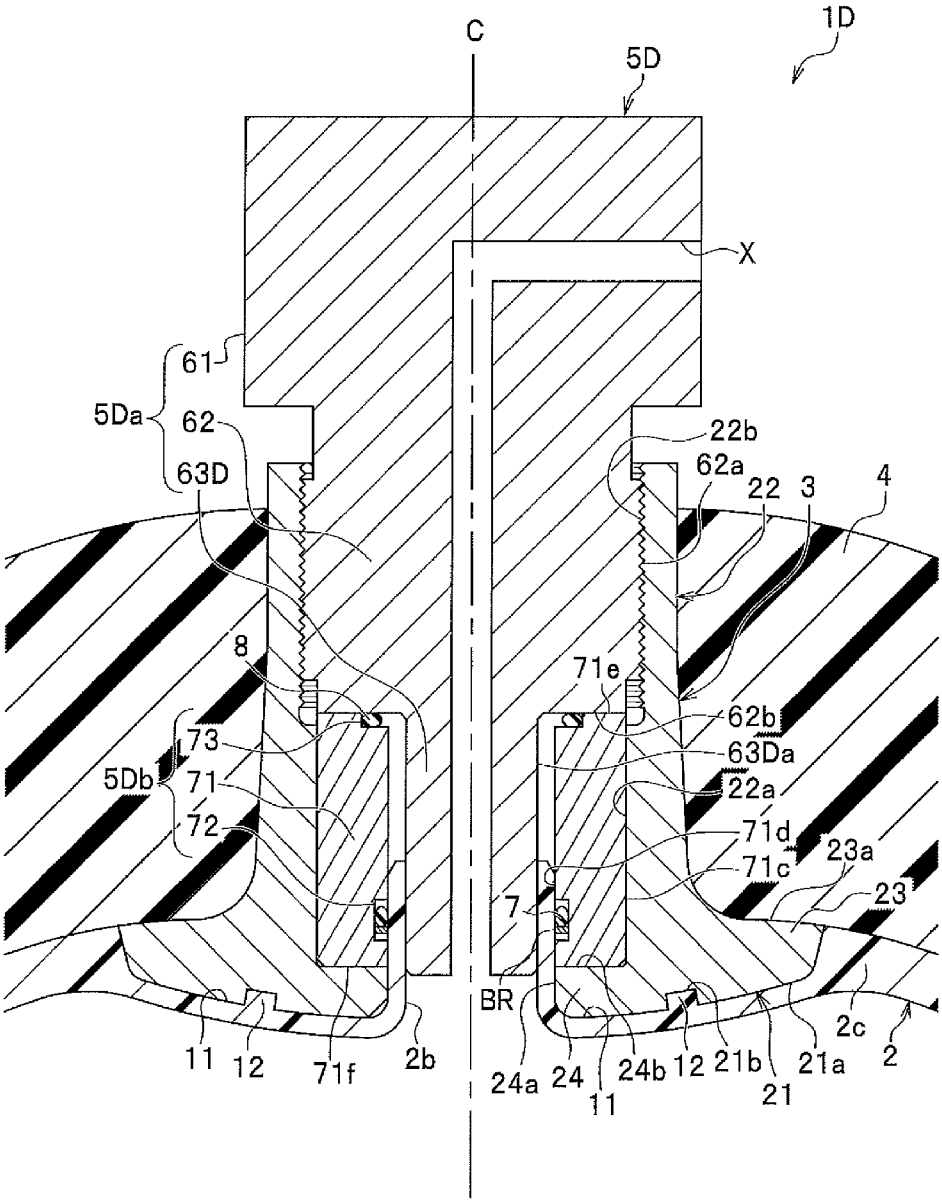
FIG. 6 is a sectional side view showing a periphery of a mouthpiece member of a first modified pressure container according to the second embodiment.

Next, a first modified example of the second embodiment will be explained. As shown in FIG. 6, in a pressure container 1D of the first modified example, the shape of an attachment member 5D differs from that of the second embodiment. In the first modified example, detailed explanations will be omitted except for giving the same symbols to portions overlapping with the second embodiment. Portions different from the second embodiment will be mainly explained.

The attachment member 5D is composed of a first member 5Da and a second member 5Db. The second member 5Db is roughly the same as the second member 5Cb (refer to FIG. 5) of the second embodiment except that an inner peripheral surface of the second member is constant. In the second modified example, an end portion 63D of the first member 5Da is extended to the neck portion 2*b*. In more detail, the end portion 63D is extended up to a position overlapping with the first seal member 7 in a direction along a central axis C. The outer diameter of the end portion 63D is the same as the inner diameter of the neck portion 2*b*. That is, an outer peripheral surface 63Da of the end portion 63D and the inner peripheral surface of the neck portion 2*b* are in contact with each other in a surface-contact state.

The pressure container 1D according to the first modified example can serve roughly the same effect as the second embodiment (refer to FIG. 5). Furthermore, since the neck portion 2*b* is held between the second member 5Db and the end portion 63D, tilting (weakening) of the neck portion 2*b* can be prevented. And furthermore, since the end portion 63D is extended up to the position overlapping the first seal member 7 in the direction along the central axis C, the seal ability between the neck portion 2*b* and the attachment member 5D (second member 5Db) can be improved.

In the above, embodiments and modified examples of the present invention have been explained. But design change can be adequately done without departing from the purpose of the present invention. For example, in the embodiments and the modified examples mentioned above, the attachment seat or the attachment seats to dispose a seal member therein are provided on the attachment member side. However, the attachment seat or the attachment seats may be provided on the outer peripheral surface of the neck portion 2*b* by means of forming a cut-off part or a step part on the outer peripheral surface of the neck portion. Even such a constitution can get seal ability. And maintenance for the seal member can be done when the attachment member is detached from the mouthpiece member 3. Furthermore, in this embodiment, the mouthpiece member 3 and the attachment member 5 are fastened by means of thread.

DESCRIPTION OF THE SYMBOLS

1 Pressure container
2 Plastic liner
2*a* Housing portion
2*b* Neck portion
2*c* Shoulder portion
3 Mouthpiece member
4 Reinforced layer
5 Attachment member
6 First seal member
7 First seal member
8 Second seal member
50 Reinforcing member

The invention claimed is:

1. A pressure container, comprising:
a hollow plastic liner provided with a projected cylindrical neck portion, and to reserve gas or liquid;
a mouthpiece member disposed outside the neck portion in a radial direction and provided with a female thread;
a reinforced layer covering outer peripheral surfaces of the plastic liner and the mouthpiece member;
an attachment member which is inserted between the neck portion and the mouthpiece member, provided with a male thread engaged with the female thread, and removably attached to the mouthpiece member and the neck portion of the plastic liner; and
a first seal member intervened between an outer peripheral surface of the neck portion and an inner peripheral surface of the attachment member,
wherein the attachment member has two separate parts of a first member to be fastened to the mouthpiece member, and a second member to be inserted between the neck portion and the mouthpiece member,
wherein the first seal member is intervened between the outer peripheral surface of the neck portion and an inner peripheral surface of the second member, and a second seal member is intervened between the first member and the second member, and
wherein the second member is held by the mouthpiece member and the first member.

2. The pressure container according to claim 1, wherein a reinforcing member is disposed on the neck portion.

* * * * *